US006526818B1

(12) United States Patent
Head et al.

(10) Patent No.: US 6,526,818 B1
(45) Date of Patent: Mar. 4, 2003

(54) SEABED ANALYSIS

(75) Inventors: Philip Head, London (GB); David Joseph French, Epsom (GB)

(73) Assignees: XL Technology Limited, London (GB); WS Atkins Consultants Limited, Epsom (GB)

( * ) Notice: Subject to any disclaimer, the term of this patent is extended or adjusted under 35 U.S.C. 154(b) by 0 days.

(21) Appl. No.: 09/552,784

(22) Filed: Apr. 20, 2000

(30) Foreign Application Priority Data

Apr. 23, 1999 (GB) ..... 9909364

(51) Int. Cl.[7] ..... E21B 47/00
(52) U.S. Cl. ..... 73/152.01; 73/170.2; 175/50
(58) Field of Search ..... 73/170.2, 152.01; 175/50

(56) References Cited

U.S. PATENT DOCUMENTS

| | | | | |
|---|---|---|---|---|
| 4,755,947 A | * | 7/1988 | Braschler et al. | 364/432 |
| 5,350,018 A | * | 9/1994 | Sorem et al. | 166/250 |
| 5,439,800 A | * | 8/1995 | Thompson | 435/9 |

FOREIGN PATENT DOCUMENTS

| | | |
|---|---|---|
| GB | 1 255 557 | 12/1971 |
| GB | 1 271 220 | 4/1972 |
| GB | 1 392 967 | 5/1975 |
| GB | 1 448 399 | 9/1976 |
| GB | 2 029 963 | 3/1980 |
| GB | 2 094 852 | 9/1982 |
| GB | 2 243 173 | 10/1991 |

* cited by examiner

*Primary Examiner*—William Oen
*Assistant Examiner*—Jermaine Jenkins
(74) *Attorney, Agent, or Firm*—Herbert Dubno

(57) ABSTRACT

Test equipment is deployed from a floating vessel or the like, the test equipment comprising testing apparatus for determining geotechnical, geophysical, geochemical, geological characteristics, and soil penetrator which forms an exploratory hole. The testing apparatus also includes at least one sensor or sampler. The test equipment being deployed by coiled tubing or the like, the one end of the coiled tubing being attached to the vessel. The test equipment is of sufficient weight to keep itself and the coiled tubing above it substantially vertical. The test equipment is also kept correctly orientated by a structure resting substantially on the seabed. A heave compensatior, such as one or more winching lines at a constant load tension which are attached to and support the coiled tubing. A casing can be attached to the test equipment and introduced to the exploratory hole by the soil penetrator. Such test equipment can be deployed at two separate locations simultaneously from the same vessel.

11 Claims, 12 Drawing Sheets

SEABED ANALYSIS

FIELD OF THE INVENTION

The present invention relates to a method and apparatus for investigating the properties of seabeds.

BACKGROUND OF THE INVENTION

When assessing a sub-sea location for its suitability for oil production, it is important to consider the characteristics of the soil. The type of soil will affect the drilling of the well and the construction of the platform in a profound way. The characteristics of the seabed soils must also be considered in the design, construction and operation of structures found on the seabed, and other construction work, such a laying oil pipes, cables, anchorages and the like. It could even be used for general prospecting and surveying.

A known systems for gathering data involve drilling a borehole in a conventional way, removing the drill string, and then lowering soil analysis equipment into the borehole. It is time consuming and difficult, not merely to remove the drill string but to introduce the soil analysis equipment into the borehole, especially where the location is in deep water. This necessitates the guidance of the soil analysis equipment into the borehole, which is complicated by the swell of the sea, which causes the vessel to rise and fall relative to the seabed.

GB 2 243 173 A discloses a method of reducing this delay and difficulty. After having removed the drill string and drill bit, the drill bit is taken off the drill string, and the soil analysis equipment put on in its place. The solid analysis equipment is then lowered into the borehole upon the drill string. This method is suitable for land, but guiding the drill string back into the borehole is not such an easy matter at sea.

The object of the present invention is to provide an apparatus for investigating soil beneath the seabed in an efficient manner.

SUMMARY OF THE INVENTION

According to the present invention there is provided a method for deploying test equipment from a floating vessel or the like, the test equipment comprising testing apparatus for determining geotechnical, geophysical, geochemical, geological characteristics, and soil penetration means which forms an exploratory hole, the testing apparatus including at least one sensor or sampling means, the test equipment being deployed by coiled tubing or the like, the one end of the coiled tubing being attached to the vessel.

Preferably the test equipment is of sufficient weight to keep itself and the coiled tubing above it substantially vertical.

Preferably the test equipment is kept correctly orientated by a structure resting substantially on the seabed.

According to another aspect of the present invention, there is provided test equipment as defined above.

Methods of testing the soil characteristics will vary for the soil type and application. Testing is intended to encompass such areas as geotechnical, geophysical, geochemical, geological testing. It is also intended to cover methods such as the use of simulators, that is miniature versions of equipment which may be developed in or on the seabed.

BRIEF DESCRIPTION OF THE DRAWINGS

A soil analysis system and apparatus will now be described, by way of example only, and not intended to be limiting, with reference to the drawings, of which.

DESCRIPTION OF THE PREFERRED EMBODIMENT

Figure 1:
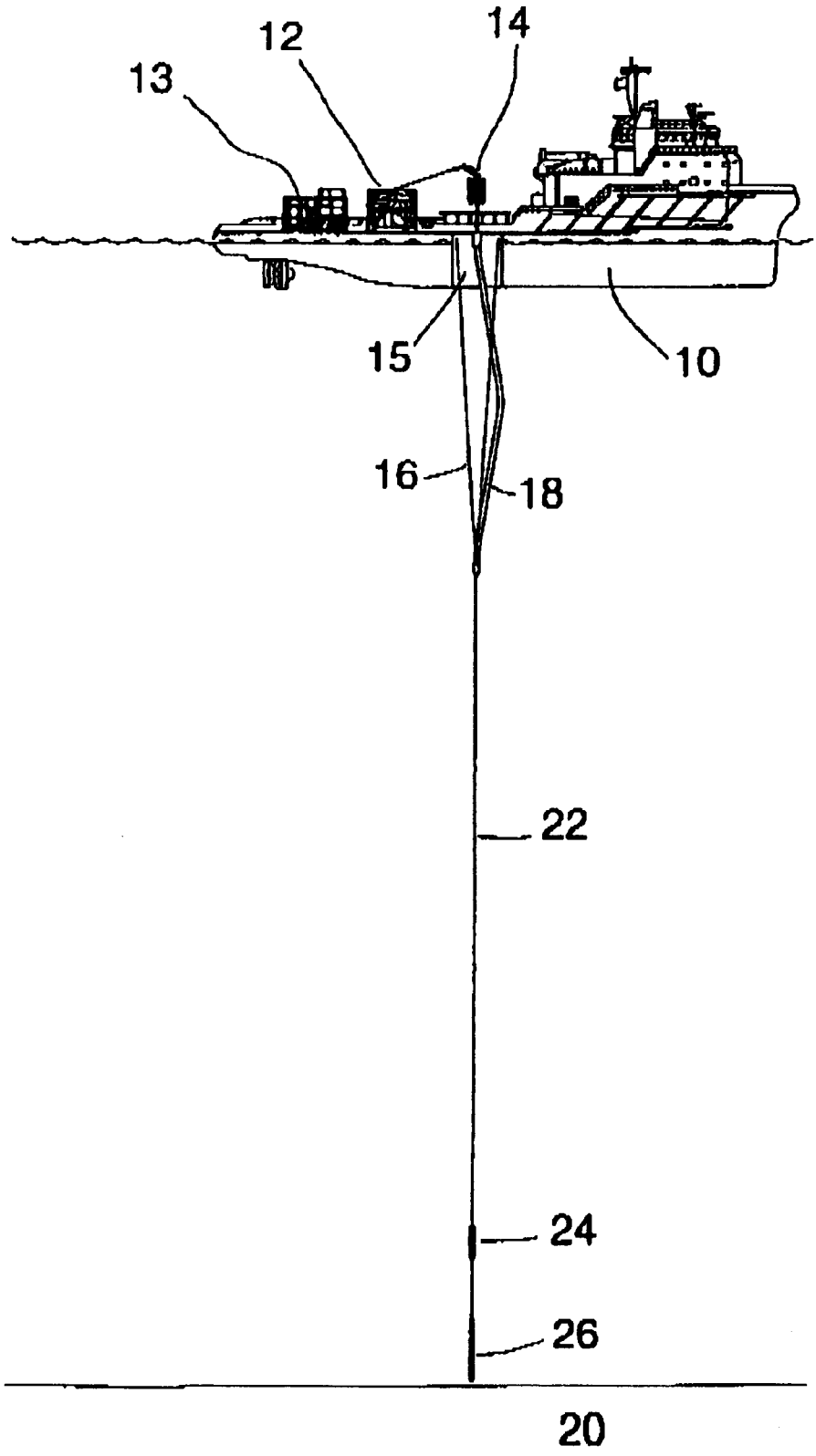
FIG. 1 shows the apparatus being disposed from a vessel

Referring to FIG. 1, a vessel 10 carrying the soil testing apparatus on board is positioned just above the point of the seabed which is to be analysed. The apparatus 26 is lowered from a gantry 14 upon the deck through a moonpool 15 in the vessel's hull. The apparatus is suspended by a length of coiled tubing (CT) 22. This CT is stowed upon a nearby reel 12. The CT is fed off the reel and paid out by an injector on the gantry. The injector releases a sufficient length of CT for the soil testing apparatus to reach the surface of the seabed. The apparatus is in electrical contact with the vessel by a wireline link which runs through the CT.

It is important that when the soil testing apparatus 26 is introduced to the soil that the swell of the sea, and the consequent movement of the vessel, does not cause the sensors contained in the apparatus to be continually pulled upon in an erratic manner. The CT 22 by which the soil testing apparatus is deployed is supported by winch lines attached at a point approximately one third of the distance from the top to the bottom of the CT. The winch lines which suspend the cable are tensioned to a constant load by a constant load means 13. Between the point at which the CT leaves the vessel and the point at which it is suspended, the CT is sheathed in a flexible guide 18. This upper section of CT is encouraged to form a curved shape, whilst the lower section of CT, between the point at which the CT is suspended and the soil testing apparatus, is kept taut by additional weights 24 strapped to the CT above the soil testing apparatus.

When the rising and falling of the sea causes the vessel 10 to move, the constant loading means 13 adjust the lengths of the winch lines 16 so as to maintain the point at which the CT 22 is suspended at a constant position with respect to the sea floor. The curvature, and therefore the distance that the upper section of the CT reaches downwards, automatically responds to the change of winch length. The lower section of the CT, and the soil testing apparatus itself, do not then move relative to the sea floor whilst soil analysis is to be performed, and are kept vertical.

Figure 2:
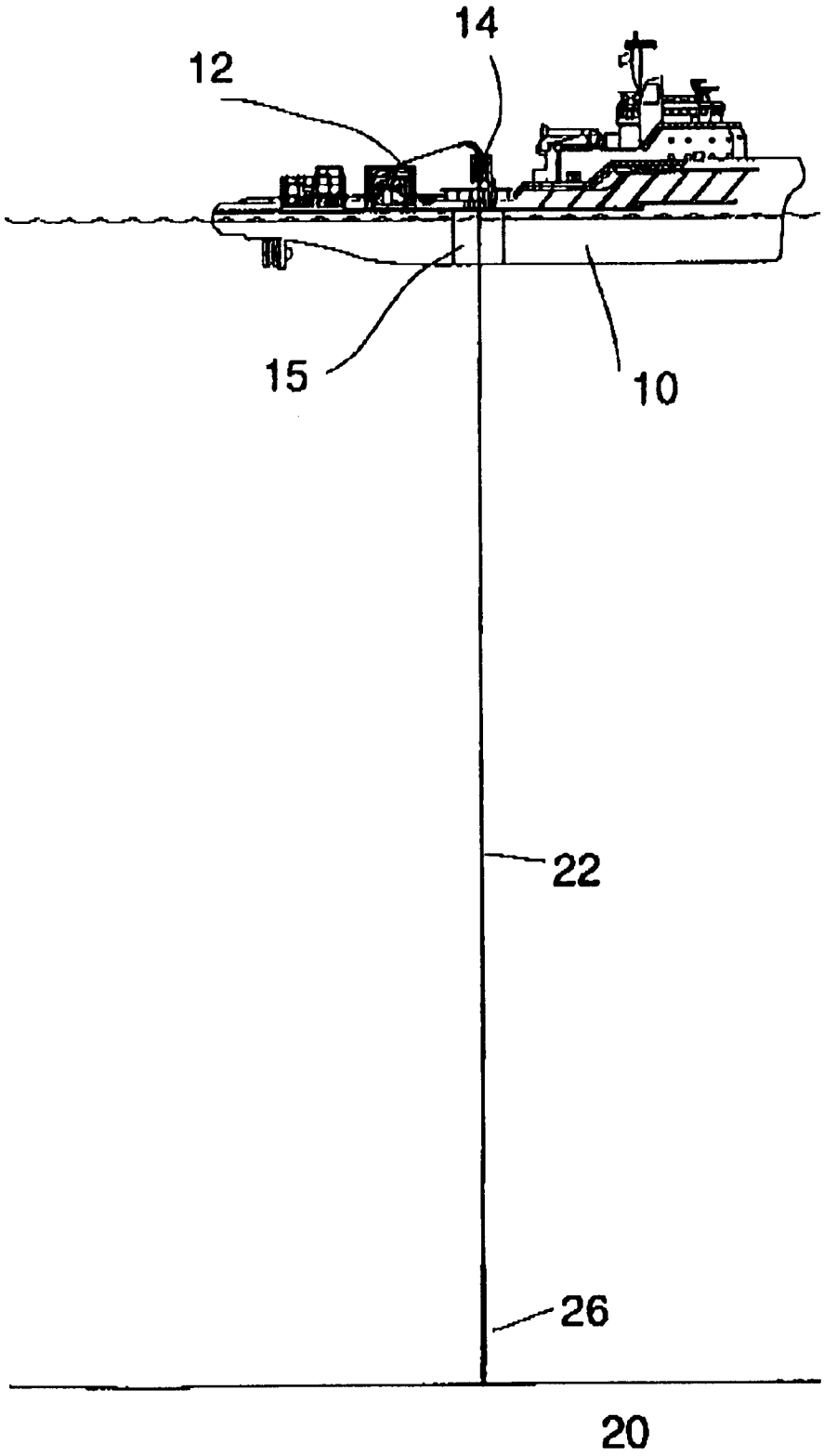
FIG. 2 shows an alternative embodiment being disposed
Figure 3A:
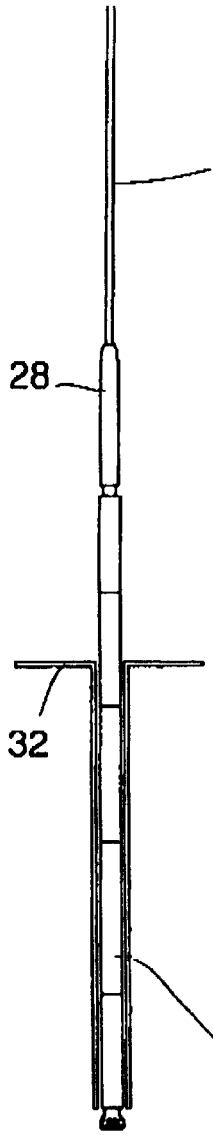
FIGS. 3*a* and 3*b* is a side elevation of the sensor means and soil penetration means of this embodiment in more detail.
Figure 3B:
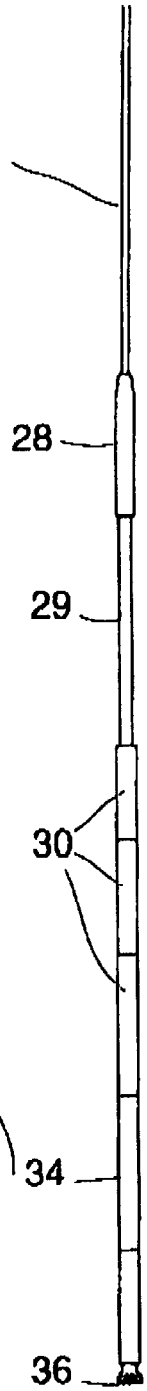

FIG. 2 shows an alternative heave control method. For this purpose, the soil testing apparatus 26 is attached to the CT 22 by a telescopic connector and weight indicator. Referring to FIGS. 3*a* and 3*b,* small movements of the CT relative to the soil testing apparatus can be absorbed by the weight indicator 28 sliding upon the telescopic connector 29. The apparent weight of the soil testing apparatus measured by the weight indicator 28 is dependent upon the acceleration of the soil testing apparatus imparted by the CT's movement. From this information, the amount of movement of the vessel relative to the seabed may be calculated, and further compensating means used to minimise the movement of the soil testing apparatus. FIG. 3*b* shows the weight indicator 28 and the telescopic connector 29 in an extended state.

Above the portion of the soil testing apparatus where the sensors 34 and the soil penetration device is located (and which will be further discussed below) weighted portions are included in order to keep the CT taut and the soil testing apparatus substantially vertical. A sleeve 32 may be included upon the soil testing apparatus, so that when the soil testing apparatus is introduced into the soil, loose soil is contained outside the borehole created. The sleeve is disposable, and is allowed to remain in the borehole after the soil testing apparatus eventually removed.

Figure 4A:
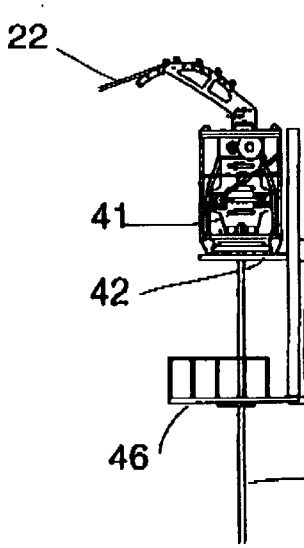
FIGS. 4*a* and 4*b* is a side elevation of part of the heave compensation means.
Figure 4B:
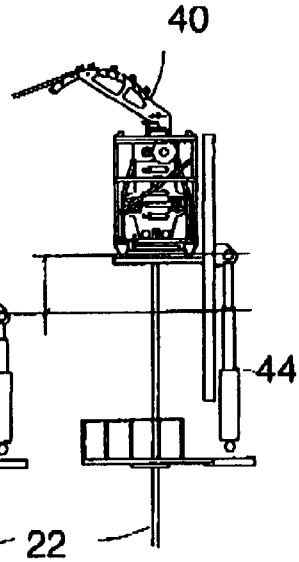

Referring to FIGS. 4*a* and 4*b,* the gantry is of the compensated deck type, that is, its deck 42 may move upwards and downwards on hydraulic means 44 relative to the vessel's deck 46. Its movement is controlled by the processed feedback from the weight indicator. There may additionally be a weight indicator upon the gantry to provide data to calculate the vessel's movement in a similar way to the weight indicator located upon the soil testing apparatus. The CT passes over a gooseneck 40 and is paid out by an injector 41. FIG. 4*b* shows the hydraulic means 44 in an extended state to raise the gantry.

Figures 5A, 5B:
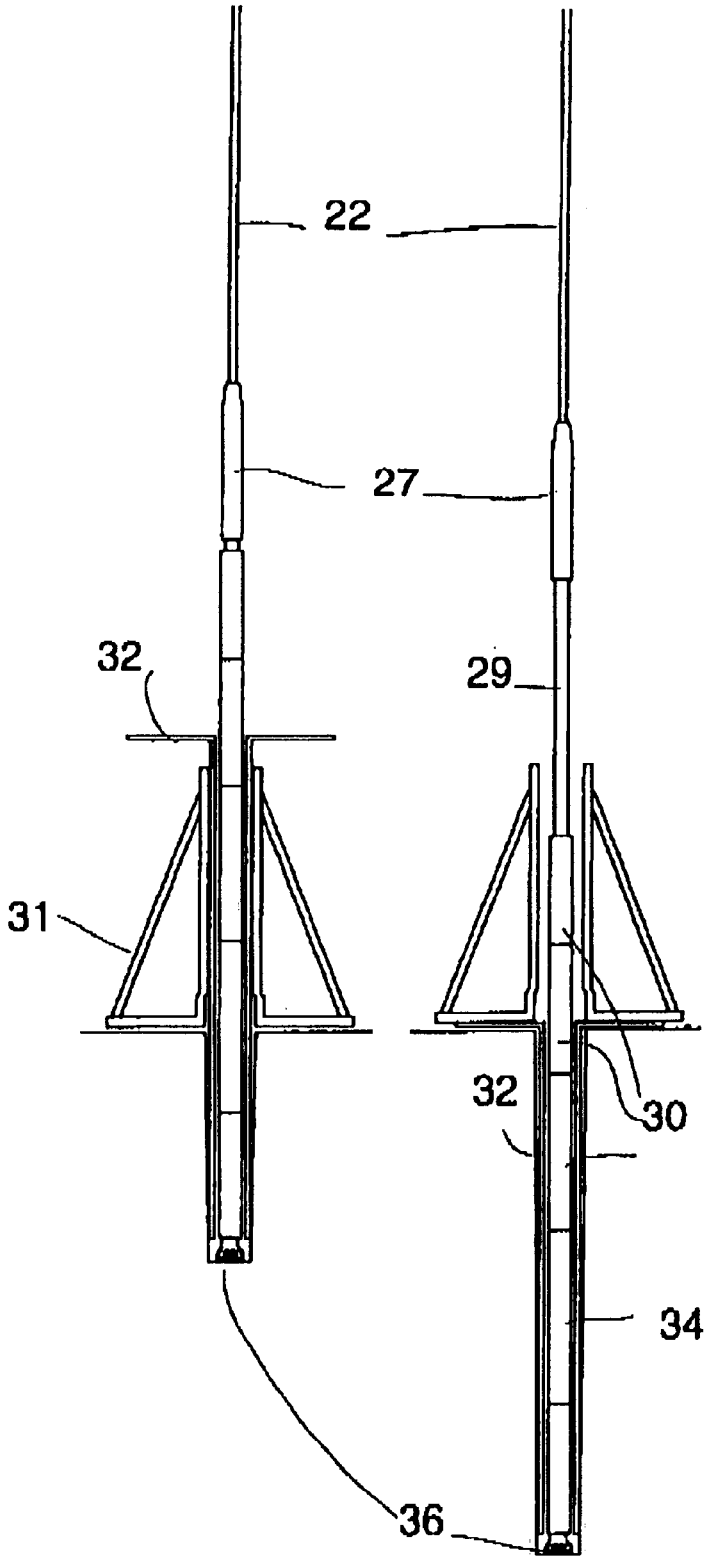
FIGS. 5*a* and 5*b* is a side elevation of an alternative embodiment of the sensor means and soil penetration means.

Referring to FIGS. 5*a* and 5*b,* the heave compensation means may be entirely in the soil testing apparatus or in the compensating deck. Here is shown a soil testing apparatus having a long telescopic connector 29 upon which slides a weighted member 27 in order to compensate for the vessels movement. Since in this embodiment the compensation means is contained entirely within the testing apparatus, a weight indicator is no longer required. In some instances, it may be that conditions are such that the weight of the testing apparatus along does not keep the testing apparatus sufficiently vertical. Also, when the testing apparatus touches the seabed, the tension in the CT will reduce, which could allow the testing apparatus to topple slightly. The testing apparatus may then have a support frame 31 attached to it, so that as the support frame's base rests horizontally upon the seabed surface, the testing apparatus is vertically constrained by the frame 31. It may even be desired that the testing apparatus is orientated at an angle to the vertical.

Figure 6:
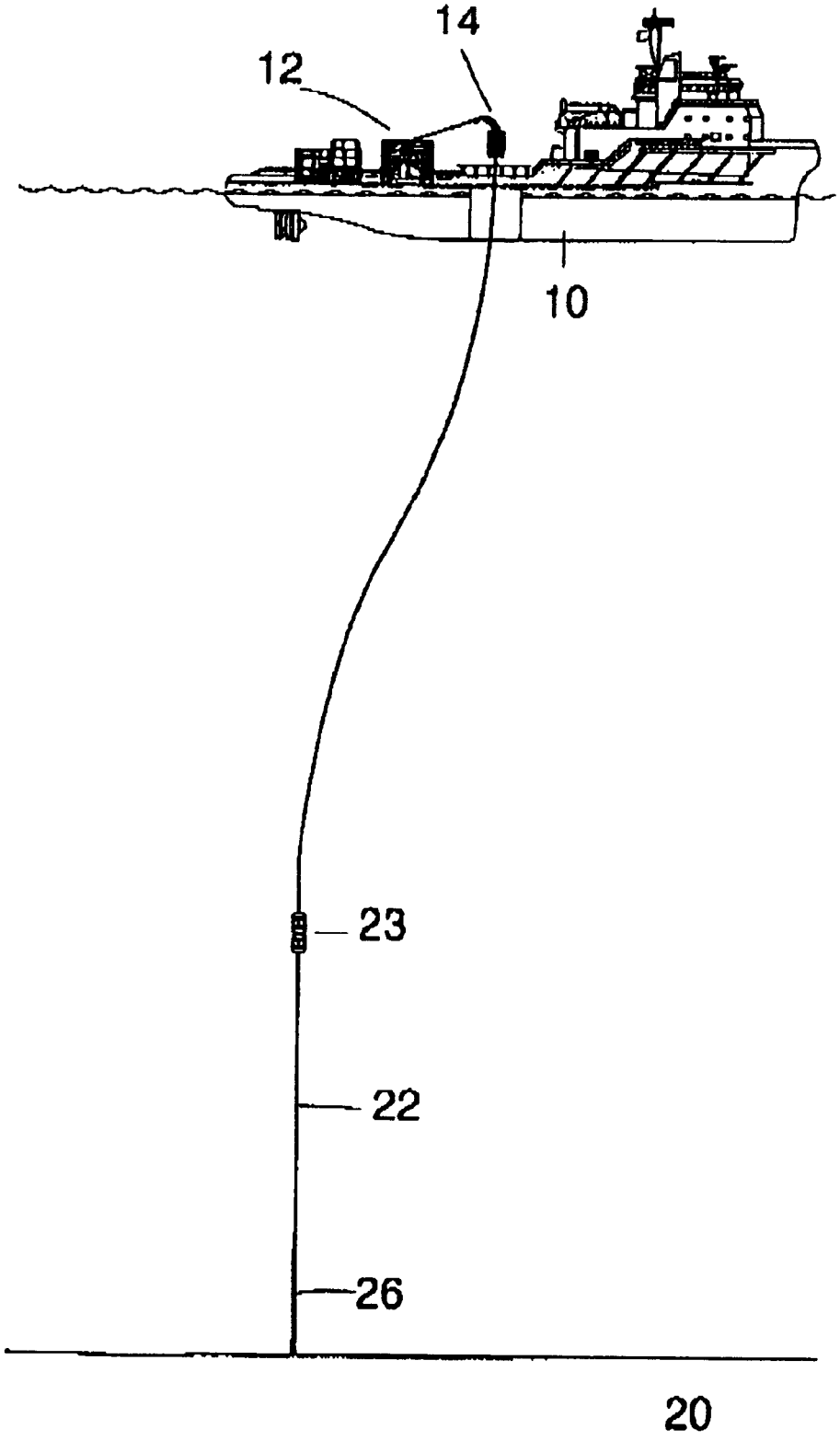
FIG. 6 shows a further embodiment being disposed

Another alternative embodiment is shown in FIG. 6, the CT 22 having buoys 23 strapped to it in a region close to the location of the soil testing apparatus. The vessel does not have to stay directly above the point on the sea bed that it is wished to analyse once the soil testing apparatus has been correctly positioned. The CT above the buoys assumes a curve to accommodate itself between the vessel and the buoys, whether the ship is rising and falling, or drifting horizontally away from the drilling position, proving that the length of CT above the buoys is of sufficient length to reach this far.

Figures 7A, 7B:
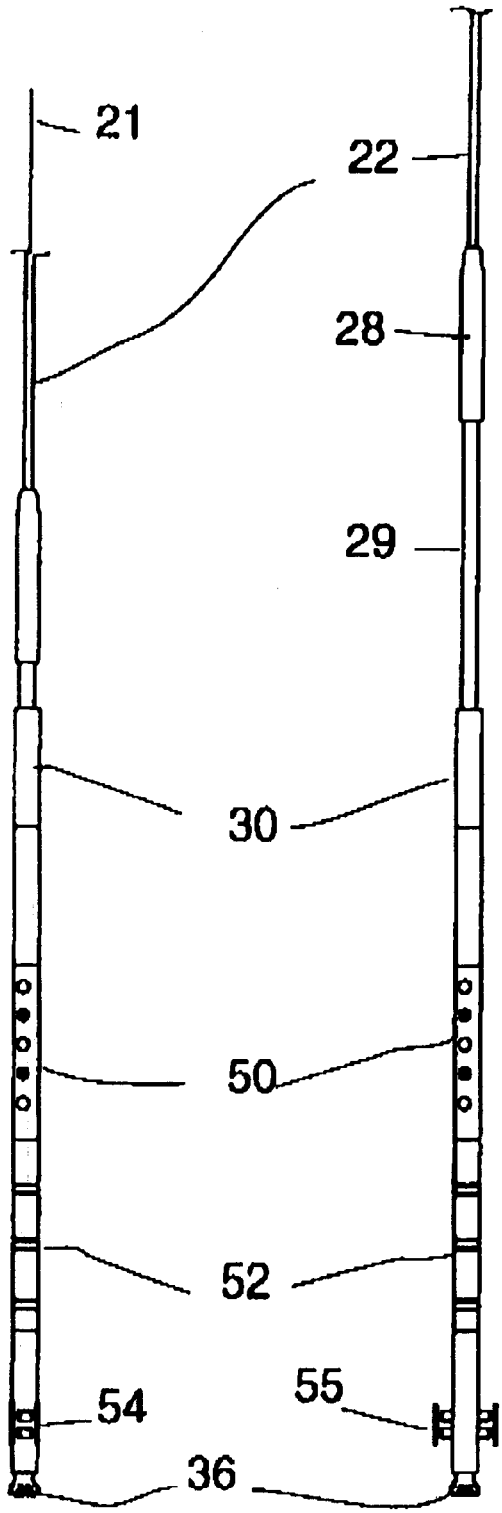
FIGS. 7*a* and 7*b* is a side elevation of the sensor means and soil penetration means in more detail.

Turning now to the soil testing apparatus itself illustrated in FIGS. 7*a* and 7*b,* the soil testing apparatus comprises a drill bit 36, instrumentation 50, weights 30, and a telescopic connector 29 and weight indicator 28, the soil testing apparatus being joined to the CT 22 which suspends it by the weight indicator. A wireline 21 inside the CT is connected to the soil testing apparatus so that the data gathered from the instrumentation may be relayed to the vessel above. The constituents of the soil testing apparatus are disposed in a linear manner, aligned to the CT.

Several cylindrical weights 30 are attached below the weight indicator and telescopic connector. The weights ensure that the soil testing apparatus is suspended plumb so that it can be accurately deployed from the vessel, and that it will penetrate the sea floor vertically. The uppermost weight includes an orientation instrument for ascertaining directional information. The weight must be made of a non-magnetic material so that the orientation instrument can function satisfactorily. The orientation instrument may be used to calculate the testing apparatus' position, and its depth of penetration. If the drilling does not proceed vertically downwards, the orientation instrument will indicate the testing apparatus' direction.

Below the weights 30 various instruments are attached. Immediately below the weights is a resistivity and gamma instrument 50, which measures the electrical resistivity of the soil by means of a probe, and the strength of gamma radiation in the soil by means of a radiation counter. Beneath this is a sonic treatment 52 which determines structural aspects of the soil by the reflection of emitted sound pulses. Other such instruments capable of gathering geotechnical, geophysical, geochemical, and/or geological data relating to the soil may be included similarly aligned in the soil testing apparatus. Included in the drill housing 54 is a side wall/impression block tester. Elements in the side wall/impression block tester extend radially, as shown in FIG. 7*b,* exerting themselves against the sides walls of the exploratory hole. This gives more data on the stress and strain characteristics of the soil, and can also indicate how cohesive the soil is.

Figures 8A, 8B:
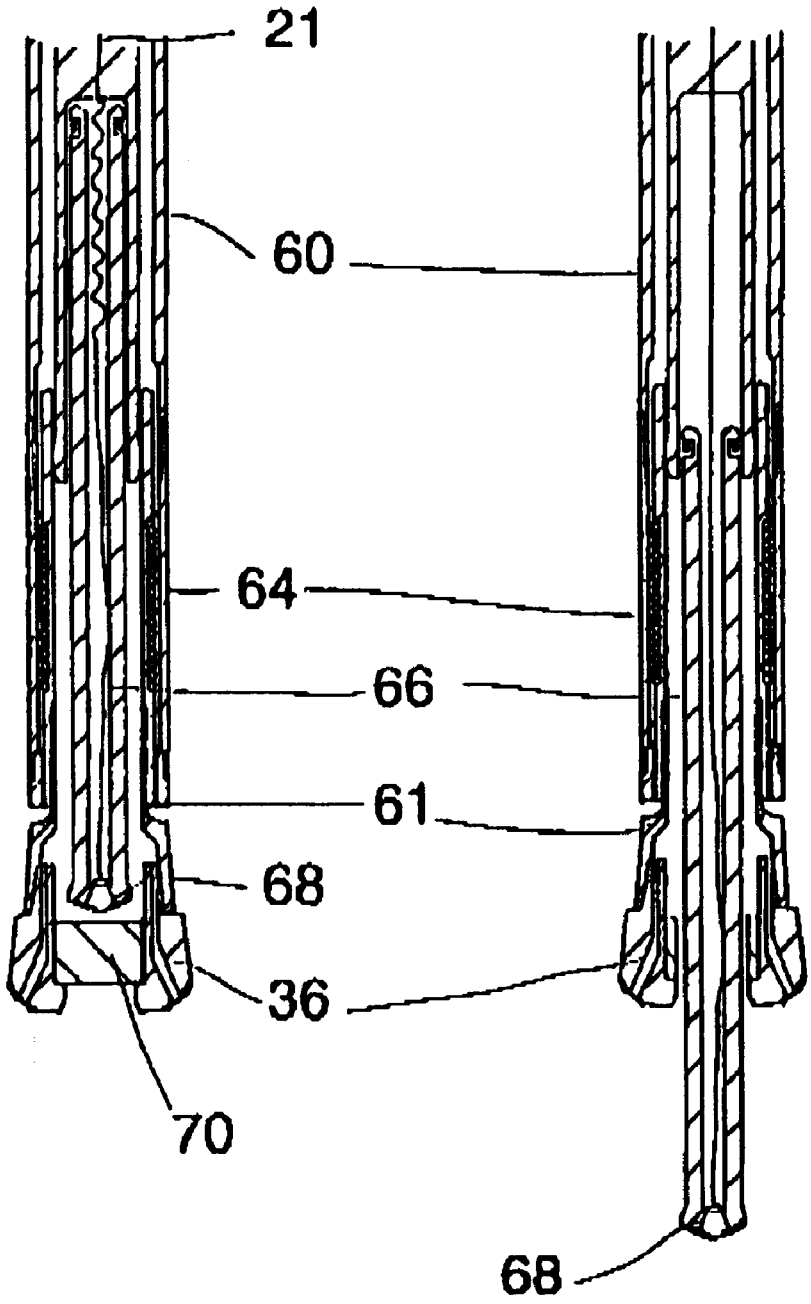
FIG. 8 is a section of the soil penetration means.

Referring to FIGS. 8*a* and 8*b,* the drill bit 36 is attached at the lower end of the drill housing 60. The drill bit 36 is mounted upon a hollow shaft 61, which is caused to rotate upon bearings 64 by fluid pumped through the CT. All the constituents of the soil testing apparatus are hollow to allow the passage of the fluid, windows such as those 62 included in the drill shaft allow the fluid to flow through the apparatus. Inside the drill housing 60 is included a probe 66 capable of measuring the stress and strain characteristics of the soil through which it passes. The probe's operation described in more detail below.

The soil testing apparatus is lowered upon the CT until it is resting with the drill bit touching the surface of the seabed. This is ascertained by monitoring the weight indicator data for a sharp decrease in the apparent weight, though other methods, such as monitoring the tension of the CT or by using other instruments in the soil testing apparatus.

Upon reaching the sea bed, the heave control means are implemented to keep the soil testing apparatus steady. Fluid is pumped down the CT, causing the drill bit to turn, and the soil testing apparatus is lowered into the sea bed. The drilling may be halted at any time, to allow measurements to be taken. Some measurements may also be taken continuously as the drilling proceeds, depending upon the particular instrument. The penetration depth can be calculated by monitoring the amount of CT paid out after the seabed surface has been reached.

Referring again to FIGS. 8*a* and 8*b,* valve means may be operated to cause the probe 66 in the drill housing 60 to slide forwards through the housing, and extend out from the openable section 70 in the middle of the drill bit 36. Sensors 68 at the tip of the probe measure the reactive force encountered when the probe pushes forwards, and from those, deductions can be made of the strength and stiffness characteristics of the soil. The data so gathered is transmitted back to the vessel via the wireline 21.

Figure 9A:
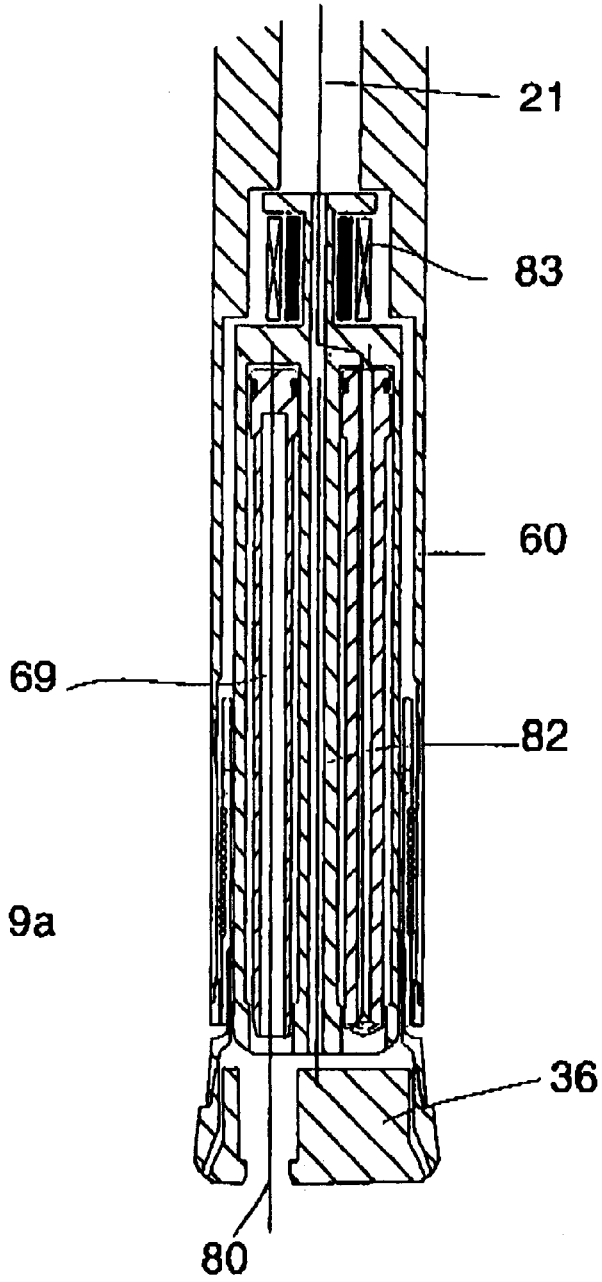
FIGS. 9*a* and 9*b* are a side elevation and a plan view of a another soil penetration means.
Figure 9B:
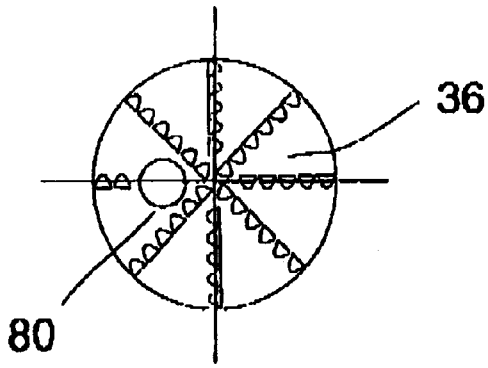

Referring to FIGS. 9*a* and 9*b,* several probes 68, samplers 69, or other instruments could be housed in the drill bit housing 69. An offset exit hole 80 is included in the drill bit 36, the various instruments being mounted on a revolving mandrel 82 so that by the indexing means 83 revolving the mandrel by a particular increment each instrument in turn is brought into alignment with the exit hole 80. Visible in the drawing is a sampler for taking a speciment of soil, and a probe. Upon being aligned with the exit hole, valve means are operated to force a particular instrument to extend out of the exit hole. When a measurement has been made, or a sample taken, further valve means are operated to pull the instrument back into the drill bit housing 60. The instruments could also be extended and retracted by mechanical means rather than hydraulic means. The instruments could also be aligned with the exit hole 80 solely by rotating the drill bit 36.

A casing could be introduced to the hole as the drilling proceeds. For example, the casing could be supported upon the CT, that is, the CT is threaded through the casing, and the casing pulled down into the exploratory hole upon the advancement of the drill bit. The soil testing apparatus may then be easily withdrawn from the exploratory hole, without the exploratory hole's sides collapsing to impede the withdrawal of the testing apparatus. An alternative method of ensuring that the testing apparatus may always be withdrawn is the inclusion of a back reamer on the testing apparatus, the back reamer re-boring the hole as the testing apparatus is pulled out. Also a release joint may be included above the soil testing apparatus, so that if the testing apparatus gets stuck, it may be sacrificed so that the CT may be retrieved.

Figures 10A, 10B:
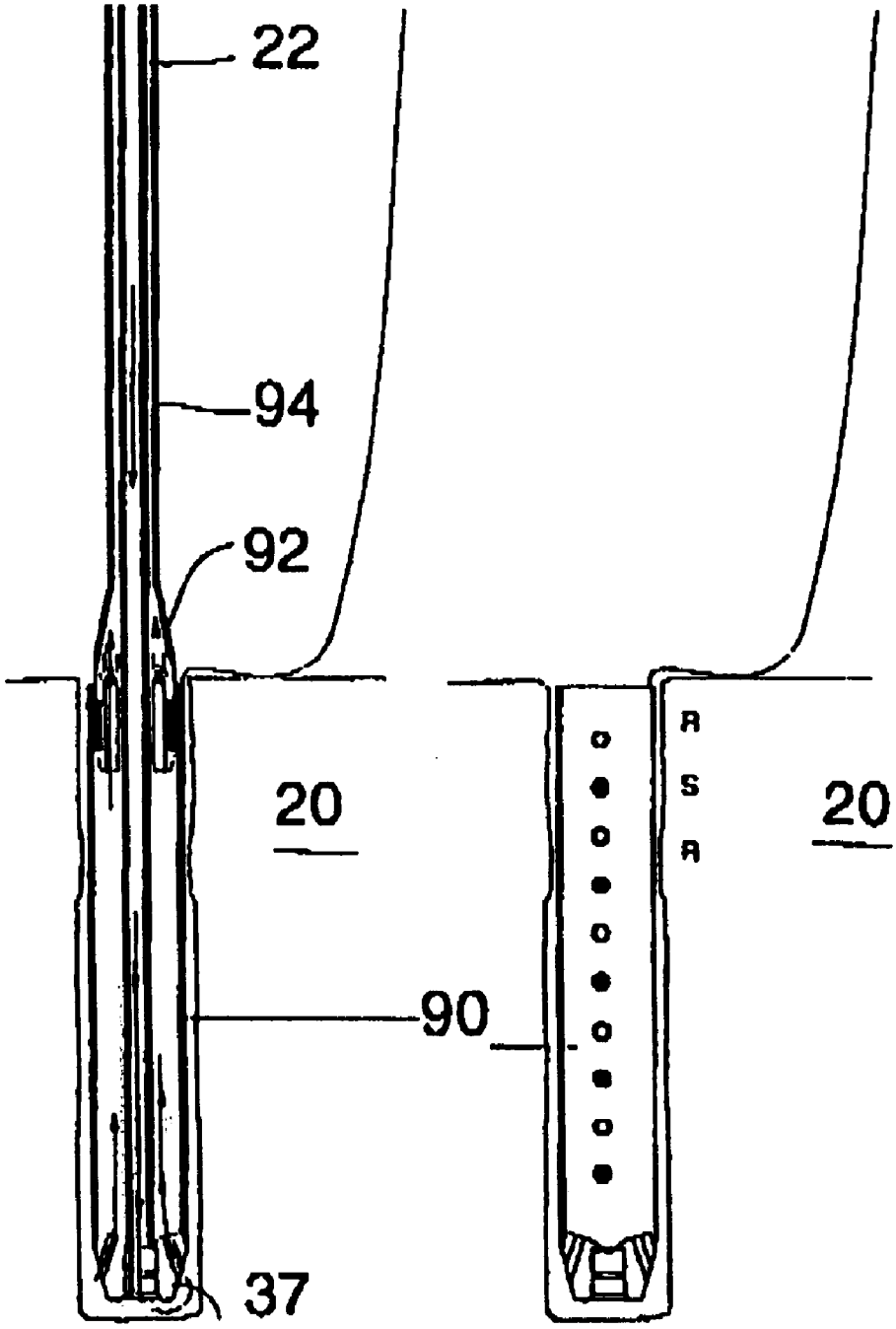
FIGS. 10*a* and 10*b* are side elevations showing the drilling process.

Referring to FIGS. 10*a* and 10*b,* such a casing 90 could form part of a tube 94 concentric with the CT 22, and extending up to the vessel. In this embodiment, fluid is passed downwards from the vessel through the CT, used for a jet penetration means 37 (an embodiment of which is described below), and returned through the casing 90 and valve system 92 into the tube concentric 22 with the CT and back to the vessel for recirculation. When the testing apparatus is withdrawn from the exploratory hole, the casing 90 is left behind, and the exploratory hole may be subsequently used for other testing purposes. Lubricating fluid, such as fluid containing Bentonite or the like, may also be passed down the CT to be used in conjunction with other soil penetration means such as a hammer bit or a vibrating cone, so that the fluid forms an annulus around the CT as it advances through the soil, thereby reducing the CT's s drag.

Figure 11A:
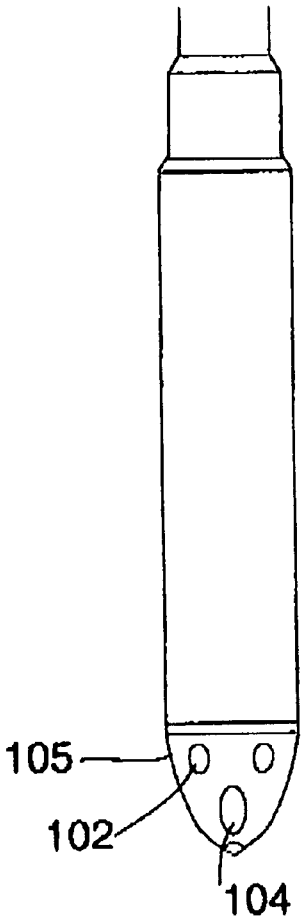
FIGS. 11*a* to 11*e* are side elevations and a plan view of a further soil penetration means.
Figure 11B:
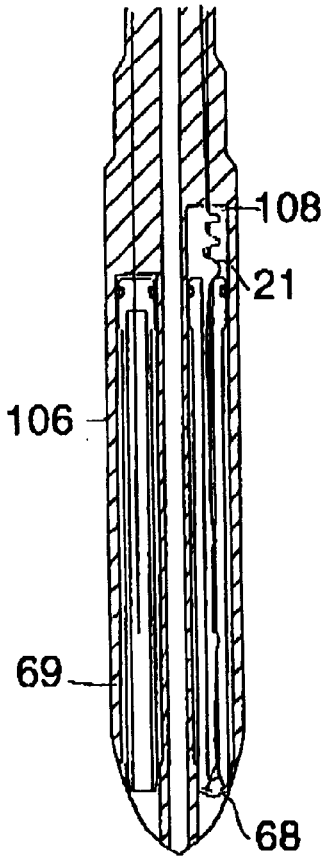
Figure 11D:
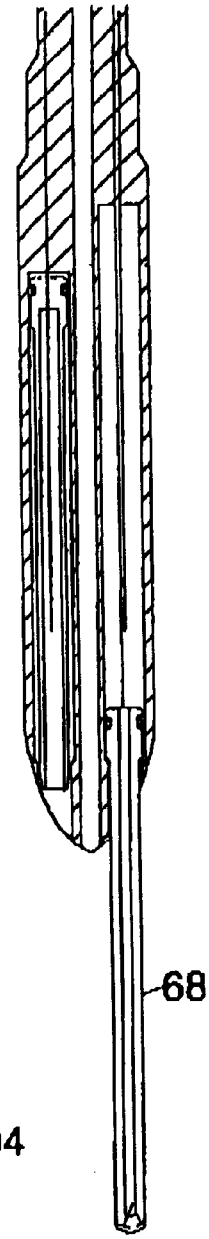
Figure 11E:
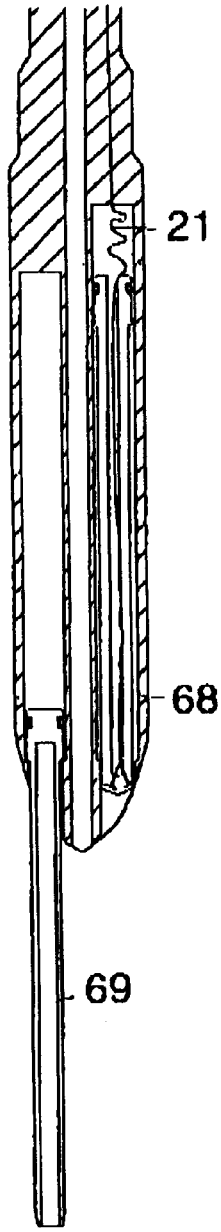
Figure 11C:
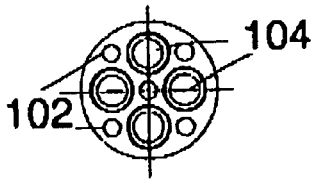

Referring to FIGS. 11*a* to 11*b,* jetting nozzles 102 are situated at the lower end 105 of the testing apparatus. Interspersed with the jetting nozzles 102 are exit holes 104, leading to barrels 106 housing probes 68 and samplers 69. As shown in FIGS. 11*d* and 11*e,* both the probes 68 and the samplers 69 are caused to extend out of the exit holes 104, by hydraulic means for example. The barrels 106 in which the probes 68 are housed have an additional space 108 for the additional length of wireline 21 needed when the probe 68 is fully extended. In this embodiment, the operation of any individual probe or sampler can be independent of the operation of other probes or samplers.

Guide means may be installed at the exploratory hole so that after the testing apparatus has been removed, other equipment may be introduced to the same hole. If this is to be done, it is preferable that a casing such as that described above is installed. In particular, sonde apparatus may be introduced to the hole to collect seismic data. For some methods of data collection, the casing should not be made of steel.

Figure 12:
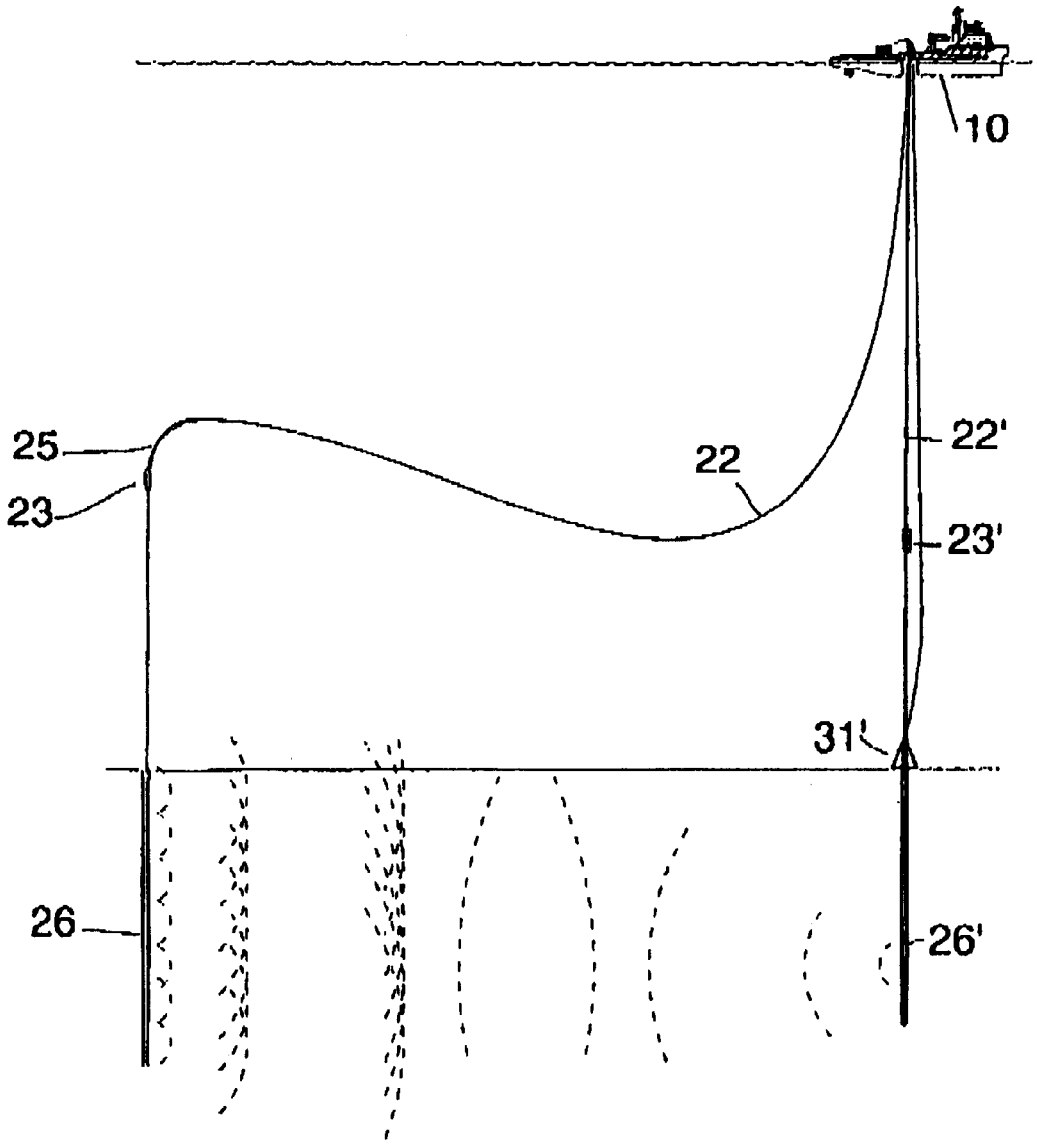
FIG. 12 shows a modification of the deployment of the invention.

Several holes may be created by the test equipment in this way. Two or more holes may be used simultaneously to gather data of the surrounding soil. Referring to FIG. 12, two testing apparatus 26,26' are installed in neighbouring holes. In this embodiment, the sonde apparatus is included in the test equipment 26,26'. One testing apparatus 26 creates a sound pulse, for example using a pressurised gas gun, and the other testing apparatus 26' receives the sound waves produced by the pulse, so that the information may be analysed to produce seismic data. An array of exploratory holes equipped with sensors and sonde apparatus may be installed in this way, to enable a three dimensional picture of the soil characteristics to be built up. A single testing apparatus may include both a sound pulse generator and a sonde apparatus receiver. The distance separating the two testing apparatus 26,26' is dependent upon the type of tests desired and the particular sensors used. When used to investigate surface properties, the testing apparatus should be typically separated by approximately 25–50 m, whereas when the testing apparatus are deeper in the soil, in order to gather data for oil exploration for example, the distance would be about 3 miles. Both testing apparatus 26,26' shown here are kept vertical by two buoys 23,23'. At least one CT 22 will have to bend significantly, having a great bending force exerted over the buoy 23. A strengthened collar 25 may be used to ensure that the CT in this region does not bend to too great a curvature in this region.

Figure 13:
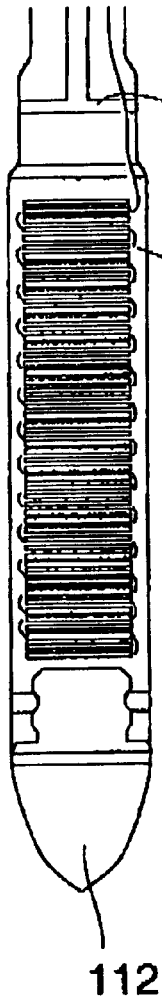
FIG. 13 is a section of a further soil penetration means.

Referring to FIG. 13, the soil penetration means is provided by a vibrating cone 112, which encourages the soil to part and allow the testing equipment to advance by agitating the soil, a channel 14 allows a lubricating fluid such as Bentonite to be deliver to the exploratory hole to reduce the dray of the advancing CT. A coiled wireline 116 is provided to link the instruments behind the cone to the vessel, the wireline uncoiling and extending as the soil penetration means advances.

Figure 14:
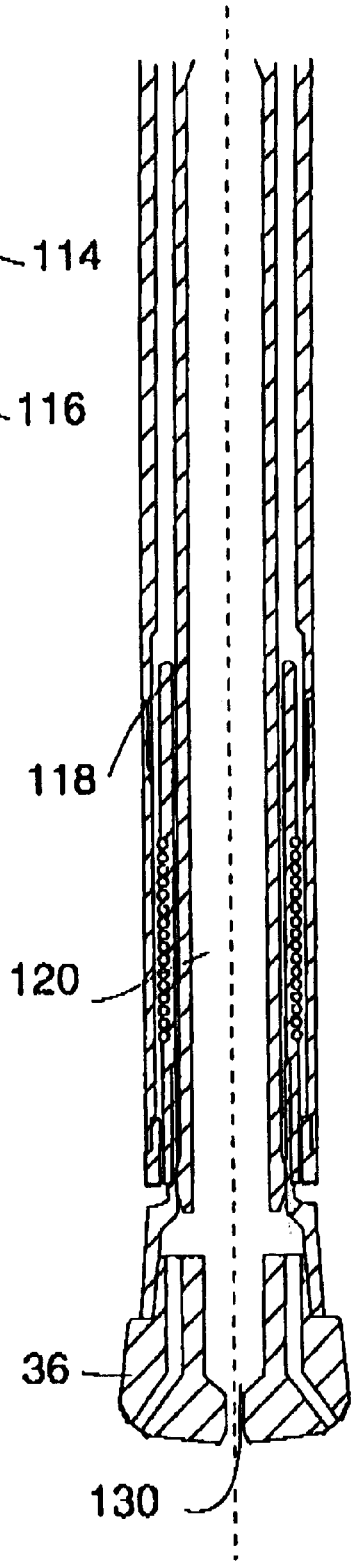
FIG. 14 is a section of a further soil penetration means.
Figure 15:
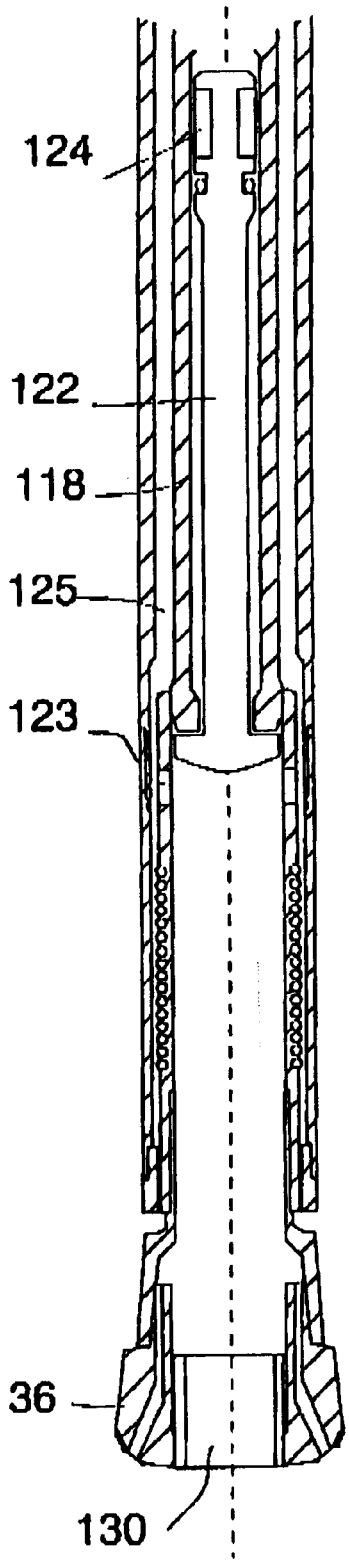
FIG. 15 is a section of a further soil penetration means.

FIG. 14 shows a drill bit being lowered upon a CT 22 and an inner concentric tube 118. The drill bit 36 has an opening which allows soil to enter the drill bit, and thence inside the inner bore 120 of the inner tube 118 to the surface. The recovered soil may then be analysed including the differentiation of soil types occurring at different depths. Instruments measuring parameters such as the advancement velocity, thrust, tool rotation, speed, torque and the mud pressure, are included to enable calculation of the depth and location of different soils brought up in the inner tube. Referring to FIG. 15, a cutting means 122, which is caused to turn by a rotating means 124, may be included in the inner tube 118. The soil is then broken up and forced out of washports 123, and then up to the surface vessel through the annulus between the inner tube and the CT.

The drill bit, rather than being rotated by fluid, could instead be electrically powered. The electric power cable could either run inside the CT, or the soil testing equipment could be suspended by an armoured cable.

The method here is suitable not only for the investigation of the properties of the soil close to the surface of the seabed, in preparation for construction or the like on the seabed, but, with a suitable soil penetration means for deep penetration of the seabed, in order, for example, to ascertain the presence of oil reservoirs. In such instances, high powered drill bits, vibrating devices and hammer drill bits (that is, the drill oscillates in a reciprocal fashion) will be necessary in order to penetrate increasing compacted soil and rock. As a greater length CT or outer casing is drag through the soil as the soil penetration means advances, the use of lubricating fluids is helpful in decreasing the drag.

It will be appreciated that although rotating drill bits and fluid jets, which usually result in the removal of soil from the hole, and vibrating devices or hammer drills, which result in the soil being compacted rather than removed, are given here as methods of forming the explanatory hole, other penetration devices could be used.

Naturally, many other types of measuring instrumentation and sample collection means may be incorporated into the soil testing apparatus. Simulators, that is miniature reproductions of actual equipment intended to be used in or on the soil of the sea bed, may be included in the testing apparatus in order to model the behaviour of the actual equipment when used in the same oil. Also, many of the alternatives given here for different aspects of the system may be effectively combined in different permutations. Alternative embodiments using the principles disclosed will suggest themselves to those skilled in the art, and it is intended that such alternatives are included within the scope of the invention, the scope of the invention being limited only by the claims.

What is claimed is:

1. A method of deploying test equipment from a floating vessel comprising the steps of:

a) lowering a soil testing apparatus at an end of a length of coiled tubing from a floating vessel until said apparatus reaches a seabed;

b) driving a powered soil penetrator with a power source on said vessel and by power transmission through said length of coiled tubing, thereby causing said apparatus to penetrate through the soil on said seabed to form an exploratory hole;

c) maintaining at least a portion of said length of said coiled tubing straight and vertical from said seabed to a location above said seabed;

d) testing a geotechnical, geophysical, geochemical or geological characteristic of said soil in said hole with at least one sensor of said apparatus and transmitting a sampling of said characteristic from said sensor through said coiled tubing to said vessel; and e) maintaining a distance between said location and said seabed constant while a distance from said location to said vessel varies with heaving of said vessel by heave compensation.

2. The method defined in claim 1 wherein said distance between said location and said seabed is maintained constant and said coiled tubing is maintained vertical and straight over said distance between said location and said seabed by weighting the coiled tubing below said location.

3. The method defined in claim 1 wherein said coiled tubing is maintained vertical above said seabed by supporting said coiled tubing on a structure resting on said seabed.

4. The method defined in claim 1 wherein said distance between said location and said seabed is maintained constant while the distance from said location to said vessel is varied with heaving of said vessel by winching in and out lines attached to said coiled tubing at said location from said vessel.

5. The method defined in claim 1 wherein said distance between said location and said seabed is maintained constant while said distance from said location to said vessel is varied and said portion of said length of said coiled tubing is maintained straight and vertical by supporting said coiled tubing at least in part by at least one buoy.

6. The method defined in claim 1 wherein said distance between said location and said seabed is maintained constant at least in part by telescoping a section of said apparatus in another section thereof.

7. The method defined in claim 1 wherein said distance from said location to said vessel is varied with heaving of said vessel by compensating movement of said vessel relative to said apparatus by displacement of a compensating deck supporting said coiled tubing on said vessel.

8. The method defined in claim 1, further comprising the step of guiding a casing into said exploratory hole on said coiled tubing and removing said coiled tubing from said hole leaving said casing in said hole.

9. The method defined in claim 1, further comprising the step of introducing another soil-testing apparatus from said vessel into the soil of said seabed at a location spaced from the first-mentioned apparatus and from a respective length of coiled tubing.

10. The method defined in claim 1, further comprising the step of displacing said sensor into the soil on the seabed from a bottom of said apparatus.

11. The method defined in claim 1, further comprising the step of displacing said sensor laterally on said apparatus into engagement with soil of said seabed surrounding said hole.

* * * * *